US008043784B2

(12) United States Patent
McGuire et al.

(10) Patent No.: US 8,043,784 B2
(45) Date of Patent: Oct. 25, 2011

(54) IMAGING MEMBER AND METHODS OF FORMING THE SAME

(75) Inventors: Gregory McGuire, Oakville (CA); Jennifer A. Coggan, Cambridge (CA); Johann Junginger, Toronto (CA); Nan-Xing Hu, Oakville (CA); Ah-Mee Hor, Mississauga (CA)

(73) Assignee: Xerox Corporation, Norwalk, CT (US)

( * ) Notice: Subject to any disclaimer, the term of this patent is extended or adjusted under 35 U.S.C. 154(b) by 938 days.

(21) Appl. No.: 12/023,281

(22) Filed: Jan. 31, 2008

(65) Prior Publication Data

US 2009/0197196 A1 Aug. 6, 2009

(51) Int. Cl.
*G03G 5/00* (2006.01)

(52) U.S. Cl. ..... 430/133; 430/58.05; 430/58.8

(58) Field of Classification Search ..... 430/133, 430/58.05, 58.8
See application file for complete search history.

(56) References Cited

U.S. PATENT DOCUMENTS

| | | | | |
|---|---|---|---|---|
| 3,121,006 | A | 2/1964 | Middleton et al. | |
| 5,686,213 | A | 11/1997 | Cosgrove et al. | |
| 7,166,397 | B2 * | 1/2007 | Mishra et al. | 430/58.8 |
| 7,291,428 | B2 * | 11/2007 | Mishra et al. | 430/58.3 |
| 2006/0099525 | A1 * | 5/2006 | Yu et al. | 430/58.05 |

* cited by examiner

*Primary Examiner* — Mark Chapman
(74) *Attorney, Agent, or Firm* — Pillsbury Winthrop Shaw Pittman LLP

(57) ABSTRACT

The presently disclosed embodiments are directed to charge transport layers useful in electrostatography. More particularly, the embodiments pertain to an improved imaging member having a charge transport layer comprising a top layer and a bottom layer, wherein the layers have varying concentrations of high quality N,N,N'N'-tetra(4-methylphenyl)-(1,1'-biphenyl)-4,4'-diamine to provide tunable discharge rate.

20 Claims, 1 Drawing Sheet

IMAGING MEMBER AND METHODS OF FORMING THE SAME

BACKGROUND

The presently disclosed embodiments relate generally to layers that are useful in imaging apparatus members and components, for use in electrostatographic, including digital, apparatuses. More particularly, the embodiments pertain to a method for forming an improved imaging member having a charge transport layer comprising a bottom layer and a top layer, wherein the layers have varying concentrations of a high quality hole transport material of a substituted biphenyl diamine, such as N,N,N'N'-tetra(4-methylphenyl)-(1,1'-biphenyl)-4,4'-diamine to provide increased discharge rate. In addition, the discharge rate of the imaging member may be tuned by varying the thicknesses of the top and bottom layers of the charge transport layer. An imaging member using a benzimidazole perylene charge generating material having tunable electrical response characteristics is disclosed in U.S. Pat. No. 5,686,213, the disclosure of which is incorporated by reference herein in its entirety. In present embodiments, a particular configuration of the charge transport layer is used to provide an improved tunable imaging member. Incorporation of anti-oxidant materials into the charge transport layer helps reduce lateral charge migration (LCM).

As used herein, the discharge rate refers to the voltage drop over time and is based upon a discharge over a discharge interval at a given light intensity, wherein discharge is defined as the voltage drop or difference between the initial surface voltage before light exposure and the surface voltage after light exposure at the end of the discharge interval. Discharge interval is defined as the time period from the light exposure stage to the development stage (which is essentially the time available for the photoreceptor surface to discharge from an initial voltage to a development voltage) and light intensity is defined as the intensity of light used to generate discharge in the photoreceptor. The exposure light intensity influences the amount of discharge, and increasing or decreasing light intensity will respectively increase or decrease the voltage drop over a given discharge interval.

Electrophotographic imaging members, e.g., photoreceptors, typically include a photoconductive layer formed on an electrically conductive substrate. The photoconductive layer is an insulator in the substantial absence of light so that electric charges are retained on its surface. Upon exposure to light, charge is generated by the photoactive pigment, and under applied field charge moves through the photoreceptor and the charge is dissipated.

In electrophotography, also known as xerography, electrophotographic imaging or electrostatographic imaging, the surface of an electrophotographic plate, drum, belt or the like (imaging member or photoreceptor) containing a photoconductive insulating layer on a conductive layer is first uniformly electrostatically charged. The imaging member is then exposed to a pattern of activating electromagnetic radiation, such as light. Charge generated by the photoactive pigment move under the force of the applied field. The movement of the charge through the photoreceptor selectively dissipates the charge on the illuminated areas of the photoconductive insulating layer while leaving behind an electrostatic latent image. This electrostatic latent image may then be developed to form a visible image by depositing oppositely charged particles on the surface of the photoconductive insulating layer. The resulting visible image may then be transferred from the imaging member directly or indirectly (such as by a transfer or other member) to a print substrate, such as transparency or paper. The imaging process may be repeated many times with reusable imaging members.

An electrophotographic imaging member may be provided in a number of forms. For example, the imaging member may be a homogeneous layer of a single material such as vitreous selenium or it may be a composite layer containing a photoconductor and another material. In addition, the imaging member may be layered. These layers can be in any order, and sometimes can be combined in a single or mixed layer.

Typical multilayered photoreceptors or imaging members have at least two layers, and may include a substrate, a conductive layer, an optional charge blocking layer, an optional adhesive layer, a photogenerating layer (sometimes referred to as a "charge generation layer," "charge generating layer," or "charge generator layer"), a charge transport layer, an optional overcoating layer and, in some belt embodiments, an anticurl backing layer. In the multilayer configuration, the active layers of the photoreceptor are the charge generation layer (CGL) and the charge transport layer (CTL). Enhancement of charge transport across these layers provides better photoreceptor performance.

The demand for improved printing capabilities in xerographic reproduction is increasing, especially in achieving increased print speeds in xerographic machines. However, because an increase in print speed reduces the time available for the surface of the imaging member to discharge, any charge still in transit will result in a higher surface voltage on the imaging member during development and result in a negative impact on print quality. Commonly used high mobility molecules have been incorporated into the charge transport layer in an attempt to increase imaging member discharge rates. However, it was discovered that high mobility characteristics in these molecules did not necessarily impart high discharge rates. Thus, conventional formulations used to make these photoreceptor layers, while suitable for their intended purpose, do not resolve the print quality issues. However, changing the existing formulations to address such issues may impact the way the photoreceptor layers interact and could adversely affect other electrical properties.

The term "photoreceptor" or "photoconductor" is generally used interchangeably with the terms "imaging member." The term "electrostatographic" includes "electrophotographic" and "xerographic." The terms "charge transport molecule" are generally used interchangeably with the terms "hole transport molecule."

SUMMARY

According to aspects illustrated herein, there is provided a method of forming an imaging member comprising providing a substrate, forming an undercoat layer on the substrate, forming a charge generation layer on the undercoat layer, and forming a charge transport layer on the charge generation layer, wherein the charge transport layer comprises a bottom layer and a top layer formed by dispersing a high concentration of a first charge transport molecule in a polymer binder to form the bottom layer and dispersing a low concentration of a second charge transport molecule in a polymer binder to form the top layer, and wherein thickness of the bottom layer and the top layer are selected in accordance with a pre-determined discharge and a pre-determined discharge interval and a pre-determined light intensity to adjust a discharge rate of the imaging member.

Another embodiment may provide a method of forming an imaging member comprising providing a substrate, forming an undercoat layer on the substrate, forming a charge generation layer on the undercoat layer, and forming a charge transport layer on the charge generation layer, wherein the charge transport layer comprises a bottom layer and a top layer formed by dispersing from about 50 percent to about 55 percent of a first charge transport molecule in a polymer binder to form the bottom layer and dispersing from about 5 percent to about 15 percent of a second charge transport molecule in a polymer binder to form the top layer, and wherein thickness of the bottom layer and the top layer are selected in accordance with a pre-determined discharge and a pre-determined discharge interval and a pre-determined light intensity to adjust discharge rate of the imaging member.

Yet another embodiment provides a method of forming an imaging member comprising selecting a pre-determined discharge and a pre-determined discharge interval and a pre-determined light intensity for an imaging member, and forming the imaging member having the pre-determined discharge and the pre-determined discharge interval and the desired light intensity further comprising providing a substrate, forming an undercoat layer on the substrate, forming a charge generation layer on the undercoat layer, and forming a charge transport layer on the charge generation layer, wherein the charge transport layer comprises a bottom layer and a top layer formed by dispersing a high concentration of high quality N,N,N'N'-tetra(4-methylphenyl)-(1,1'-biphenyl)-4,4'-diamine in a polymer binder to form the bottom layer and dispersing a low concentration of high quality N,N,N'N'-tetra (4-methylphenyl)-(1,1'-biphenyl)-4,4'-diamine in a polymer binder to form the top layer and wherein thickness of the bottom layer and the top layer are selected in accordance with the pre-determined discharge and the pre-determined discharge interval and the pre-determined light intensity to adjust a discharge rate of the imaging member.

BRIEF DESCRIPTION OF THE DRAWINGS

For a better understanding, reference may be had to the accompanying figures.

DETAILED DESCRIPTION

Figure 1:
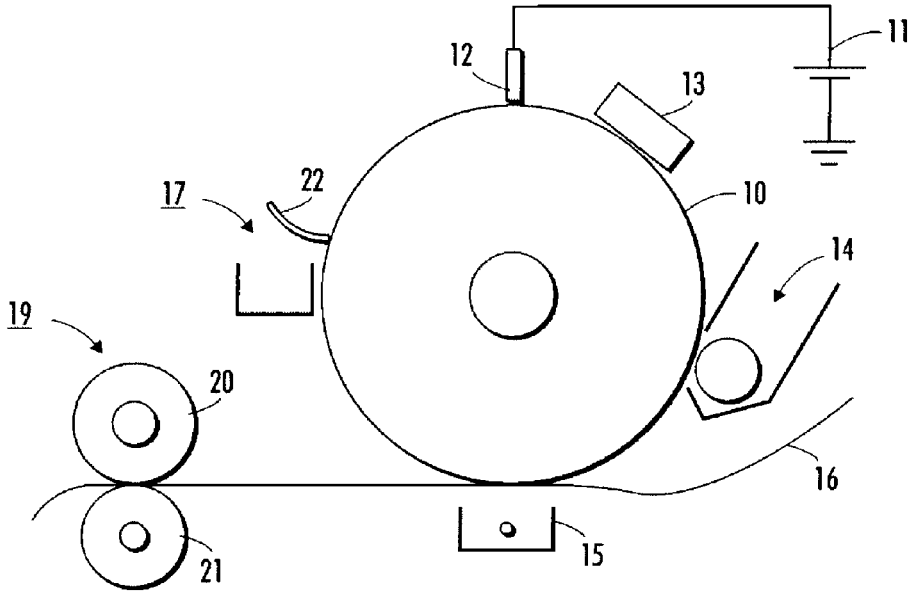
FIG. 1 is a schematic nonstructural view showing an image forming apparatus according to the present embodiments.

In the following description, reference is made to the accompanying drawings, which form a part hereof and which illustrate several embodiments. It is understood that other embodiments may be utilized and structural and operational changes may be made without departure from the scope of the present disclosure. The same reference numerals are used to identify the same structure in different figures unless specified otherwise. The structures in the figures are not drawn according to their relative proportions and the drawings should not be interpreted as limiting the disclosure in size, relative size, or location.

The presently disclosed embodiments are directed generally to an improved imaging member having a specific configuration that provides improved performance and methods for making the same. The configuration provides an tunable imaging member with improved control of the surface discharge speed.

More particularly, the embodiments pertain to a method for forming an improved imaging member having a charge transport layer comprising a bottom layer (first pass) and a top layer (second pass). The method comprises making a first pass to form the bottom layer having a high concentration of high quality N,N,N'N'-tetra(4-methylphenyl)-(1,1'-biphenyl)-4,4'-diamine and then making a second pass to form the top layer having a low concentration of high quality N,N,N'N'-tetra(4-methylphenyl)-(1,1'-biphenyl)-4,4'-diamine. The charge transport layer formulation uses high quality N,N,N'N'-tetra(4-methylphenyl)-(1,1'-biphenyl)-4,4'-diamine, as a hole transport material, in a polymer binder. High quality N,N,N'N'-tetra(4-methylphenyl)-(1,1'-biphenyl)-4,4'-diamine transport molecules provide very high rate discharge, not previously achieved in organic photoconductors. By using a high concentration first pass and a low concentration second pass, the surface discharge rate of the imaging member may be tuned by varying the thickness of the top and bottom layers. Tunability means that voltage drop over time can be selected by modifying the thicknesses of the top and bottom layers. As used herein, the term "high quality" refers to a substituted biphenyl diamine that, when incorporated into a photoreceptor, the photoreceptor containing 50 percent by weight of the substituted biphenyl diamine will discharge from about 90 percent to about 100 percent of its surface potential in from about 0 to about 40 milliseconds upon being subjected to xerographic charging and exposure to radiant energy of about 1 ergs/cm$^2$ to about 3 ergs/cm$^2$.

The present embodiments provide a configuration which increases the surface discharge rate such that an increase in print speed can be achieved without adversely affecting print quality. Because an increase in print speed reduces the time available for the surface to discharge, any charge still in transit will result in a higher surface voltage on the imaging member during development and result in a negative impact on print quality. Different high mobility molecules, such as N,N'-bis(3-methylphenyl)-N,N'-bis(4-n-butylphenyl)(p-terphenyl)-4,4'-diamine and the like, have been used in an attempt to increase imaging member discharge speeds. However, it was discovered that high mobility characteristics in these molecules did not impart high discharge rate.

Referring to FIG. 1, in a typical imaging forming apparatus, a light image of an original to be copied is recorded in the form of an electrostatic latent image upon a photosensitive member and the latent image is subsequently rendered visible by the application of electroscopic thermoplastic resin particles which are commonly referred to as toner. Specifically, photoreceptor 10 is charged on its surface by means of an electrical charger 12 to which a voltage has been supplied from power supply 11. The photoreceptor is then imagewise exposed to light from an optical system or an image input apparatus 13, such as a laser and light emitting diode, to form an electrostatic latent image thereon. Generally, the electrostatic latent image is developed by bringing a developer mixture from developer station 14 into contact therewith. Development can be effected by use of a magnetic brush, powder cloud, or other known development process.

After the toner particles have been deposited on the photoconductive surface, in image configuration, they are transferred to a copy sheet 16 by transfer means 15, which can be pressure transfer or electrostatic transfer. In embodiments, the developed image can be transferred to an intermediate transfer member and subsequently transferred to a copy sheet.

After the transfer of the developed image is completed, copy sheet 16 advances to fusing station 19, depicted in FIG. 1 as fusing and pressure rolls, wherein the developed image is fused to copy sheet 16 by passing copy sheet 16 between the fusing member 20 and pressure member 21, thereby forming a permanent image. Fusing may be accomplished by other fusing members such as a fusing belt in pressure contact with a pressure roller, fusing roller in contact with a pressure belt, or other like systems. Photoreceptor 10, subsequent to transfer, advances to cleaning station 17, wherein any toner left on photoreceptor 10 is cleaned therefrom by use of a blade 24 (as shown in FIG. 1), brush, or other cleaning apparatus.

In a selected embodiment, the method provides for an image forming apparatus for forming images on a recording medium comprising: a) an imaging member having a charge retentive-surface for receiving an electrostatic latent image thereon, wherein the imaging member comprises a substrate having a first and second side, wherein the substrate has a conductive surface, an undercoat layer disposed on the first side of the substrate, and an imaging layer disposed on the undercoat layer, wherein the imaging layer comprises a generation layer disposed on the undercoat layer, and a charge transport layer disposed on the charge generation layer, wherein the charge transport layer comprises a bottom layer having a high concentration of high quality N,N,N'N'-tetra(4-methylphenyl)-(1,1'-biphenyl)-4,4'-diamine and a top layer having a low concentration of high quality N,N,N'N'-tetra(4-methylphenyl)-(1,1'-biphenyl)-4,4'-diamine; b) a development component for applying a developer material to the charge-retentive surface to develop the electrostatic latent image to form a developed image on the charge-retentive surface; c) a transfer component for transferring the developed image from the charge-retentive surface to a copy substrate; and d) a fusing component for fusing the developed image to the copy substrate.

Figure 2:
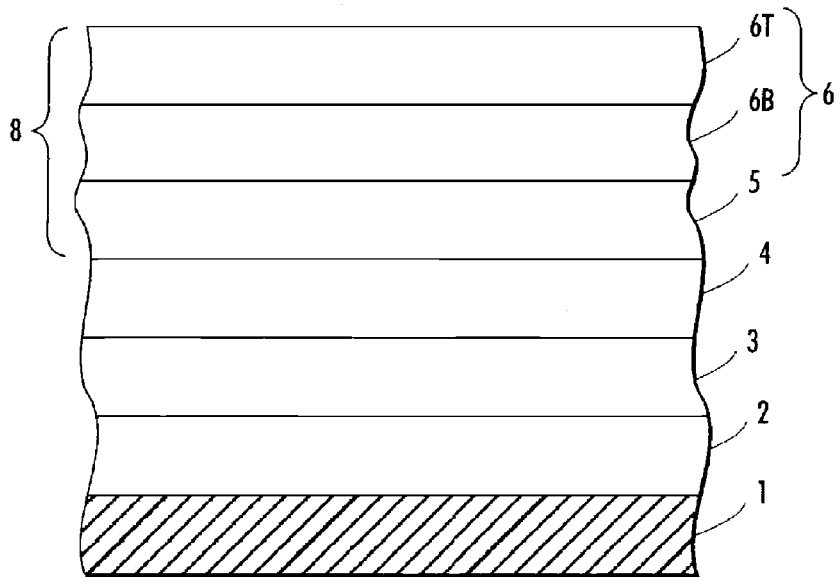
FIG. 2 is a cross-sectional view of an imaging member showing various layers according to the present embodiments.

Electrophotographic imaging members may be prepared by any suitable technique. Referring to FIG. 2, typically, a flexible or rigid substrate 1 is provided with an electrically conductive surface or coating 2. The substrate may be opaque or substantially transparent and may comprise any suitable material having the required mechanical properties. Accordingly, the substrate may comprise a layer of an electrically non-conductive or conductive material such as an inorganic or an organic composition. As electrically non-conducting materials, there may be employed various resins known for this purpose including polyesters, polycarbonates, polyamides, polyurethanes, and the like which are flexible as thin webs. An electrically conducting substrate may be any metal, for example, aluminum, nickel, steel, copper, and the like or a polymeric material, as described above, filled with an electrically conducting substance, such as carbon, metallic powder, and the like or an organic electrically conducting material. The electrically insulating or conductive substrate may be in the form of an endless flexible belt, a web, a rigid cylinder, a sheet and the like. The thickness of the substrate layer depends on numerous factors, including strength desired and economical considerations. Thus, for a drum, this layer may be of substantial thickness of, for example, up to many centimeters or of a minimum thickness of less than a millimeter. Similarly, a flexible belt may be of substantial thickness, for example, about 250 micrometers, or of minimum thickness less than 50 micrometers, provided there are no adverse effects on the final electrophotographic device.

Substrate

In embodiments where the substrate layer is not conductive, the surface thereof may be rendered electrically conductive by an electrically conductive coating 2. The conductive coating may vary in thickness over substantially wide ranges depending upon the optical transparency, degree of flexibility desired, and economic factors. Accordingly, for a flexible photoresponsive imaging device, the thickness of the conductive coating may be between about 20 angstroms to about 750 angstroms, or from about 100 angstroms to about 200 angstroms for an optimum combination of electrical conductivity, flexibility and light transmission. The flexible conductive coating may be an electrically conductive metal layer formed, for example, on the substrate by any suitable coating technique, such as a vacuum depositing technique or electrodeposition. Typical metals include aluminum, zirconium, niobium, tantalum, vanadium and hafnium, titanium, nickel, stainless steel, chromium, tungsten, molybdenum, and the like.

Hole Blocking Layer

An optional hole blocking layer or undercoat layer 3 may be applied to the substrate 1 or coating. Any suitable and conventional blocking layer capable of forming an electronic barrier to holes between the adjacent photoconductive layer 8 (or electrophotographic imaging layer 8) and the underlying conductive surface 2 of substrate 1 may be used.

Adhesive Layer

An optional adhesive layer 4 may be applied to the hole-blocking layer 3. Any suitable adhesive layer well known in the art may be used. Typical adhesive layer materials include, for example, polyesters, polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the hole blocking layer include spraying, dip coating, roll coating, wire wound rod coating, gravure coating, Bird applicator coating, and the like. Drying of the deposited coating may be effected by any suitable conventional technique such as oven drying, infrared radiation drying, air drying and the like.

At least one electrophotographic imaging layer 8 is formed on the adhesive layer 4, blocking layer 3 or substrate 1. The electrophotographic imaging layer 8 has both a charge generation layer 5 and charge transport layer 6. In the present embodiments, the charge transport layer 6 has a top layer 6T and a bottom layer 6B. Layer 6T may have thicknesses of from about 9 μm to about 16 μm in embodiments, or from about 5 μm to about 25 μm in other embodiments, but thicknesses outside of these ranges may also be used. Layer 6B may have thicknesses of from about 15 μm to about 22 μm in embodiments, or from about 5 μm to about 25 μm in other embodiments, but thicknesses outside of these ranges may also be used.

Charge Generation Layer

The charge generation layer 5 can be applied to the electrically conductive surface, or on other surfaces in between the substrate 1 and charge generating layer 5. A charge blocking layer or hole-blocking layer 3 may optionally be applied to the electrically conductive surface prior to the application of a charge generating layer 5. If desired, an adhesive layer 4 may be used between the charge blocking or hole-blocking layer 3 and the charge generation layer 5. Usually, the charge generation layer 5 is applied onto the blocking layer 3 and a charge transport layer 6, is formed on the charge generation layer 5.

Charge generator layers may comprise amorphous films of selenium and alloys of selenium and arsenic, tellurium, germanium and the like, hydrogenated amorphous silicon and compounds of silicon and germanium, carbon, oxygen, nitrogen and the like fabricated by vacuum evaporation or deposition. The charge-generator layers may also comprise inorganic pigments of crystalline selenium and its alloys; Group II-VI compounds; and organic pigments such as quinacridones, polycyclic pigments such as dibromo anthanthrone pigments, perylene and perinone diamines, polynuclear aromatic quinones, azo pigments including bis-, tris- and tetrakis-azos; and the like dispersed in a film forming polymeric binder and fabricated by solvent coating techniques.

Phthalocyanines have been employed as photogenerating materials for use in laser printers using infrared exposure systems. Infrared sensitivity is required for photoreceptors exposed to low-cost semiconductor laser diode light exposure devices. The absorption spectrum and photosensitivity of the phthalocyanines depend on the central metal atom of the compound. Many metal phthalocyanines have been reported and include, oxyvanadium phthalocyanine, chloroaluminum phthalocyanine, copper phthalocyanine, oxytitanium phthalocyanine, chlorogallium phthalocyanine, hydroxygallium phthalocyanine magnesium phthalocyanine and metal-free phthalocyanine. The phthalocyanines exist in many crystal forms, and have a strong influence on photogeneration.

Any suitable polymeric film forming binder material may be employed as the matrix in the charge-generating (photogenerating) binder layer. Typical polymeric film forming materials include those described, for example, in U.S. Pat. No. 3,121,006, the entire disclosure of which is incorporated herein by reference. Thus, typical organic polymeric film forming binders include thermoplastic and thermosetting resins such as polycarbonates, polyesters, polyamides, polyurethanes, polystyrenes, polyarylethers, polyarylsulfones, polybutadienes, polysulfones, polyethersulfones, polyethylenes, polypropylenes, polyimides, polymethylpentenes, polyphenylene sulfides, polyvinyl acetate, polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, polyvinylchloride, vinylchloride and vinyl acetate copolymers, acrylate copolymers, alkyd resins, cellulosic film formers, poly(amideimide), styrenebutadiene copolymers, vinylidenechloride-vinylchloride copolymers, vinylacetate-vinylidenechloride copolymers, styrene-alkyd resins, polyvinylcarbazole, and the like. These polymers may be block, random or alternating copolymers. The photogenerating composition or pigment is present in the resinous binder composition in various amounts.

Any suitable and conventional technique may be used to mix and thereafter apply the photogenerating layer coating mixture. Typical application techniques include spraying, dip coating, roll coating, wire wound rod coating, vacuum sublimation, and the like. For some applications, the generator layer may be fabricated in a dot or line pattern. Removing of the solvent of a solvent coated layer may be effected by any suitable conventional technique such as oven drying, infrared radiation drying, air drying and the like.

Dual Charge Transport Layer

In the present embodiments, the charge transport layer 6 has a top layer 6T and a bottom layer 6B. These layers 6T and 6B may have thicknesses of from about 2 μm to about 30 μm in embodiments, or from 9 μm to about 22 μm in other embodiments, but thicknesses outside of these ranges may also be used.

The charge transport layer 6 may comprise a charge transporting molecule dissolved or molecularly dispersed in a film forming electrically inert polymer such as a polycarbonate. The term "dissolved" as employed herein is defined herein as forming a solution in which the charge transporting molecule is dissolved in the polymer to form a homogeneous phase. The expression "molecularly dispersed" is used herein is defined as a charge transporting molecule dispersed in the polymer, the charge transporting molecules being dispersed in the polymer on a molecular scale. Any suitable charge transporting molecule or electrically active small molecule may be employed in the charge transport layer of this invention. The expression charge transporting "small" is defined herein as a monomer that allows the free charge photogenerated in the transport layer to be transported across the transport layer. Typical charge transporting small molecules include, for example, pyrazolines such as 1-phenyl-3-(4'-diethylamino styryl)-5-(4"-diethylamino phenyl)pyrazoline, diamines such as N,N'-diphenyl-N,N'-bis(3-methylphenyl)-(1,1'-biphenyl)-4,4'-diamine, hydrazones such as N-phenyl-N-methyl-3-(9-ethyl)carbazyl hydrazone and 4-diethyl amino benzaldehyde-1,2-diphenyl hydrazone, and oxadiazoles such as 2,5-bis(4-N,N'-diethylaminophenyl)-1,2,4-oxadiazole, stilbenes and the like. However, to avoid cycle-up in machines with high throughput, the charge transport layer should be substantially free (less than about two percent) of di or triamino-triphenyl methane. As indicated above, suitable electrically active small molecule charge transporting compounds are dissolved or molecularly dispersed in electrically inactive polymeric film forming materials.

If desired, the charge transport material in the charge transport layer may comprise a polymeric charge transport material or a combination of a small molecule charge transport material and a polymeric charge transport material.

Any suitable electrically inactive resin binder insoluble in the alcohol solvent may be employed in the charge transport layer of this invention. Typical inactive resin binders include polycarbonate resin (such as MAKROLON 5705®), polyester, polyarylate, polyacrylate, polyether, polysulfone, and the like. Molecular weights can vary, for example, from about 20,000 to about 150,000. Examples of binders include polycarbonates such as poly(4,4'-isopropylidene-diphenylene) carbonate (also referred to as bisphenol-A-polycarbonate, poly(4,4'-cyclohexylidinediphenylene)carbonate (referred to as bisphenol-Z polycarbonate), poly(4,4'-isopropylidene-3,3'-dimethyl-diphenyl)carbonate (also referred to as bisphenol-C-polycarbonate) and the like. Any suitable charge transporting polymer may also be used in the charge transporting layer of this invention. The charge transporting polymer should be insoluble in the alcohol solvent employed to apply the overcoat layer of this invention. These electrically active charge transporting polymeric materials should be capable of supporting the injection of photogenerated holes from the charge generation material and be capable of allowing the transport of these holes there through.

In the present embodiments, the method provides an imaging member comprising a charge transport layer having a bottom layer (first pass) and a top layer (second pass). The top layer has a low concentration of high quality N,N,N'N'-tetra (4-methylphenyl)-(1,1'-biphenyl)-4,4'-diamine, while the bottom layer has a high concentration of high quality N,N,N'N'-tetra(4-methylphenyl)-(1,1'-biphenyl)-4,4'-diamine. The charge transport layer formulation uses high quality N,N,N'N'-tetra(4-methylphenyl)-(1,1'-biphenyl)-4,4'-diamine, as a hole transport material, in a polymer binder. By using a high concentration first pass and a low concentration second pass, the surface discharge rate of the imaging member may be tuned by varying the thickness of the top and bottom layers. Using this configuration increases the surface discharge rate such that an increase in print speed can be achieved without adversely affecting print quality. Thus, the present embodiments provide a method for forming an imaging member that has tunable discharge rate.

The discharge rate is tuned by first selecting a pre-determined or desired discharge, a desired discharge interval, and a desired exposure light intensity, and then by varying the bi-layer thicknesses of the charge transport layer to provide the desired discharge and the desired discharge interval and the desired light intensity. In embodiments, the imaging member has a desired discharge, desired discharge interval, and desired exposure light intensity such that the imaging member is capable of use in standard electrostatographic imaging processes. In particular embodiments, the imaging member has a desired discharge range from about 50 percent to about 98 percent of its initial surface potential and a desired discharge interval from about 10 milliseconds to about 1000 milliseconds. In further embodiments, the imaging member is subjected to a desired light intensity of from about 2 ergs/cm to about 30 ergs/cm.

In one embodiment, there is provided a method for forming the imaging member comprising selecting a desired discharge and a desired discharge interval and a desired light intensity for an imaging member and forming the imaging member having the desired discharge, the desired discharge interval and the desired light intensity further comprising providing a substrate, forming an undercoat layer on the substrate, forming a charge generation layer on the undercoat layer, and forming a charge transport layer on the charge generation layer, wherein the charge transport layer comprises a first layer (bottom layer) and a second layer (top layer) formed by dispersing a high concentration of high quality N,N,N'N'-tetra(4-methylphenyl)-(1,1'-biphenyl)-4,4'-diamine in a polymer binder to form the first layer (bottom layer) and dispersing a low concentration of high quality N,N,N'N'-tetra(4-methylphenyl)-(1,1'-biphenyl)-4,4'-diamine in a polymer binder to form the second layer (top layer) and wherein the charge transport first layer (bottom layer) and second layer (top layer) thickness are selected in accordance with the desired discharge, the desired discharge interval and the desired light intensity to adjust the desired discharge, the desired discharge interval and the light intensity of the imaging member.

In embodiments, the top layer formed may have a concentration of high quality N,N,N'N'-tetra(4-methylphenyl)-(1,1'-biphenyl)-4,4'-diamine in a weight percent range from about 0 percent to about 50 percent or from about 0 percent to about 20 percent, or more specifically from about 5 percent to about 15 percent. The bottom layer may have a concentration of high quality N,N,N'N'-tetra(4-methylphenyl)-(1,1'-biphenyl)-4,4'-diamine in a weight percent range from about 45 percent to about 65 percent, or more specifically from about 50 percent to about 60 percent, or more specifically from about 50 percent to about 55 percent. In specific embodiments, the method forms an imaging member such that the difference in concentration of high quality N,N,N'N'-tetra(4-methylphenyl)-(1,1'-biphenyl)-4,4'-diamine in the top layer and the bottom layer is from about 35 percent to about 55 percent, or from about 40 percent to about 50 percent, or from about 40 percent to about 45 percent.

The transport molecule N,N,N'N'-tetra(4-methylphenyl)-(1,1'-biphenyl)-4,4'-diamine is found to have very good discharge properties when it is of high quality. While having twice the mobility of another commonly used transport molecule, N,N'-diphenyl-N,N'-bis(3-methylphenyl)-[1,1'-biphenyl]-4,4'-diamine, N,N,N'N'-tetra(4-methylphenyl)-(1,1'-biphenyl)-4,4'-diamine is shown to exhibit much shorter discharge time when used in a charge transport layer. For example, it was shown that a high quality N,N,N'N'-tetra(4-methylphenyl)-(1,1'-biphenyl)-4,4'-diamine based imaging member is capable of discharging four to six times faster than an imaging member having the same concentration of N,N'-diphenyl-N,N'-bis(3-methylphenyl)-[1,1'-biphenyl]-4,4'-diamine. However, N,N,N'N'-tetra(4-methylphenyl)-(1,1'-biphenyl)-4,4'-diamine can cause undesirable LCM.

In further embodiments, the top and bottom charge transport layers comprise a tertiary aryl amine charge transport molecule represented by the following general formula:

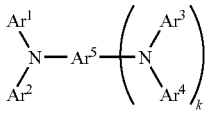

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1.

Specific anti-oxidant materials can be added to the low concentration top layer or to both layers in order to reduce LCM that can be exhibited by N,N,N'N'-tetra(4-methylphenyl)-(1,1'-biphenyl)-4,4'-diamine. Having a low concentration top layer and adding specific anti-oxidant materials like phenolics (2,2'-Methylenebis(4-ethyl-6-tert-butylphenol)) 4,4'-thiobis(6-tert-butyl-o-cresol) (both available from CYTEC Industries Inc., West Paterson, N.J.) to the top layer or to both layers gives the desired LCM resistance even with variable layer thicknesses and without substantial electrical impact.

The specific anti-oxidant materials are chosen because they have been shown to introduce minimal electrical impact thus not affecting discharge performance while also minimizing LCM. By using the specific combination of high quality N,N,N'N'-tetra(4-methylphenyl)-(1,1'-biphenyl)-4,4'-diamine and 2,2'-Methylenebis(4-ethyl-6-tert-butylphenol), or other anti-oxidant materials in this class, the method achieves a large latitude in discharge rates. In embodiments, the method includes incorporation of the anti-oxidant material in the formed CTL such that the anti-oxidant material is present in the top layer or each of the top and bottom layers in an amount of from about 2 percent to about 10 percent, or from about 5 percent to about 7 percent by weight of the total solids.

Generally, the thickness of a charge transport layer is between about 10 and about 50 micrometers, or from about 10 μm to about 40 μm, or more specifically from about 25 to about 35 μm. In the present embodiments, the top layer of the charge transport layer 6T may be formed to have a thickness of from about 9 μm to about 16 μm, or in other embodiments from about 5 μm to about 25 μm, but thicknesses outside of these ranges may also be used. In the present embodiments, the bottom layer of the charge transport layer 6B may have a thickness of from about 15 μm to about 22 μm, or in other embodiments from about 5 μm to about 25 μm, but thicknesses outside of these ranges may also be used. The combined thickness of the top layer and the bottom layer may be from about 10 μm to about 50 μm or from about 25 μm to about 35 μm.

Any suitable and conventional technique may be used to mix and thereafter apply the charge transport layer coating mixture to the charge generating layer. Typical application techniques include spraying, dip coating, roll coating, wire wound rod coating, and the like. Drying of the deposited coating may be effected by any suitable conventional technique such as oven drying, infrared radiation drying, air drying and the like.

The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layers can be maintained from about 2:1 to 200:1 and in some instances as great as 400:1. The charge transport layer, is substantially non-absorbing to visible light or radiation in the region of intended use but is electrically "active" in that it allows the injection of photogenerated holes from the photoconductive layer, e.g., charge generation layer, and allows these holes to be transported through itself to selectively discharge a surface charge on the surface of the active layer.

In embodiments, the method further includes coating an overcoat layer on the charge-transporting layer. Any suitable or conventional technique may be used to mix and thereafter apply the overcoat layer coating mixture on the charge transport layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating should transport holes during imaging and should not have too high a free carrier concentration. Free carrier concentration in the overcoat increases the dark decay. The dark decay of the overcoated layer should be about the same as that of the uncoated, control device.

Various exemplary embodiments encompassed herein include a method of imaging which includes generating an electrostatic latent image on an imaging member, developing a latent image, and transferring the developed electrostatic image to a suitable substrate.

While the description above refers to particular embodiments, it will be understood that many modifications may be made without departing from the spirit thereof. The accompanying claims are intended to cover such modifications as would fall within the true scope and spirit of embodiments herein.

The presently disclosed embodiments are, therefore, to be considered in all respects as illustrative and not restrictive, the scope of embodiments being indicated by the appended claims rather than the foregoing description. All changes that come within the meaning of and range of equivalency of the claims are intended to be embraced therein.

EXAMPLES

The example set forth herein below and is illustrative of different compositions and conditions that can be used in practicing the present embodiments. All proportions are by weight unless otherwise indicated. It will be apparent, however, that the embodiments can be practiced with many types of compositions and can have many different uses in accordance with the disclosure above and as pointed out hereinafter.

N,N,N'N'-tetra(4-methylphenyl)-(1,1'-biphenyl)-4,4'-diamine (Compound 1): The purification procedures to produce N,N,N'N'-tetra(4-methylphenyl)-(1,1'-biphenyl)-4,4'-diamine with a purity of 98 to 100 percent could include train sublimation, a Kaufmann column run with alumina and a non-polar solvent such as hexane, hexanes, cyclohexane, heptane and the like, absorbent treatments such as with the use of alumina, clay, charcoal and the like and recrystallization to produce the desired purity.

The compound could also be prepared through other reactions such as a Buchwald-Hartwig reaction and any other obvious reactions to those skilled in the art which would produce the desired compound. The purity of the final material may be instrumental in obtaining the improved electrical and mechanical properties

Example 1

An imaging or photoconducting member incorporating Compound 1 was prepared in accordance with the following procedure. A metallized mylar substrate was provided and a HOGaPc/poly(bisphenol-Z carbonate) photogenerating layer was machine coated over the substrate. The photogenerating layer was overcoated with a 1$^{st}$ layer (bottom layer) charge transport layer prepared by introducing into an amber glass bottle 51.1 weight percent of high quality N,N,N'N'-tetra(4-methylphenyl)-(1,1'-biphenyl)-4,4'-diamine (Compound 1), synthesized as discussed above, having a purity of from about 99 to about 100 percent as determined by HPLC and NMR and 42.1 weight percent of MAKROLON 5705®, a known polycarbonate resin having a molecular weight average of from about 50,000 to about 100,000, commercially available from Farbenfabriken Bayer A. G and 6.8 weight percent of 2,2'-Methylenebis(4-ethyl-6-tert-butylphenol) (Compound 2). The resulting mixture was then dissolved in methylene chloride to form a solution containing 15 percent by weight solids. This solution was applied on the photogenerating layer to form a layer coating that upon drying (120° C. for 1 minute) had a thickness of 15.5 microns. During this coating process, the humidity was equal to or less than about 15 percent. The 1$^{st}$ pass (bottom layer) charge transport layer was then overcoated with a 2$^{nd}$ pass (top layer) charge transport layer by repeating the process of preparing and coating the 1$^{st}$ layer charge transport except that the 2$^{nd}$ layer (top layer) charge transport layer is prepared by introducing into an amber glass bottle 9.2 weight percent of high quality N,N,N'N'-tetra(4-methylphenyl)-(1,1'-biphenyl)-4,4'-diamine (Compound 1) and 84 weight percent of MAKROLON 5705® and 6.8 weight percent of 2,2'-Methylenebis(4-ethyl-6-tert-butylphenol)(Compound 2 2. This solution was applied on top of the 1$^{st}$ layer (bottom layer) charge transport layer to form a layer coating that upon drying (120° C. for 1 minute) had a thickness of 15.5 microns. The combined total thickness of the two layer charge transport layer was 31 microns.

Comparative Example 1

For comparison purposes, a commercially available photoreceptor containing N,N'-diphenyl-N,N-bis(3-methylphenyl)-1,1'-biphenyl-4,4'-diamine transport molecule at concentrations of about 43 percent (comparative example 1) is used as "benchmark" reference device.

Examples 2-5

Photoconductor examples 2 through 5 were prepared by repeating the process of Example 1 except that, in example 2, the 1$^{st}$ layer (bottom) layer charge transport layer was applied on top of the photogenerating layer such that the thickness was 17.3 microns and the 2$^{nd}$ layer (top layer) charge transport layer was applied on top of the 1$^{st}$ layer (bottom layer) charge transport layer such that the thickness was 12.0. In example 3, the 1$^{st}$ layer (bottom) layer charge transport layer was applied on top of the photogenerating layer such that the thickness was 20.5 microns and the 2$^{nd}$ layer (top layer) charge transport layer was applied on top of the 1$^{st}$ layer (bottom layer) charge transport layer such that the thickness was 10.1. In example 4, the 1$^{st}$ layer (bottom) layer charge transport layer was prepared by introducing into an amber glass bottle 55 weight percent of high quality N,N,N'N'-tetra (4-methylphenyl)-(1,1'-biphenyl)-4,4'-diamine (Compound 1) and 45 weight percent of MAKROLON 5705% and 0 percent 2,2'-Methylenebis(4-ethyl-6-tert-butylphenol)(Compound 2), and the solution was applied on top of the photogenerating layer such that the thickness was 15.8 microns and the 2$^{nd}$ layer (top layer) charge transport layer applied on top of the 1$^{st}$ layer (bottom layer) charge transport layer such that the thickness was 15.9 microns. In example 5, the 1st layer (bottom) layer charge transport layer was prepared by introducing into an amber glass bottle 55 weight percent of high quality N,N,N'N'-tetra(4-methylphenyl)-(1,1'-biphenyl)-4,4'-diamine (Compound 1) and 45 weight percent of MAKROLON 5705®) and 0 percent 2,2'-Methylenebis(4-ethyl-6-tert-butylphenol)(compound 2), and the solution was applied on top of the photogenerating layer such that the thickness was 21.4 microns and the 2nd layer (top layer) charge transport layer applied on top of the 1st layer (bottom layer) charge transport layer such that the thickness was 9.5 microns.

Comparative Example 2

A comparative Photoconductor (comparative example 2) was prepared by introducing into an amber glass bottle 50 weight percent of high quality N,N,N'N'-tetra(4-methylphenyl)-(1,1'-biphenyl)-4,4'-diamine (Compound 1), and 50 weight percent of MAKROLON 5705®. The resulting mixture was then dissolved in methylene chloride to form a solution containing 15 percent by weight solids. This solution was applied on the photogenerating layer to form a layer coating that upon drying (120° C. for 1 minute) had a thickness of 30 microns. During this coating process, the humidity was equal to or less than about 15 percent.

Experimental devices having variable Charge transport layer thicknesses were fabricated and tested against the comparative example 1 device. The specific details of the experimental devices are illustrated in Table 1.

Discharge Rate Measurement:

Discharge rate was evaluated by measuring the surface potential of the photoconductor at specified time intervals after photo exposure. Discharge rate was determined by electrostatically charging the surfaces of the imaging members with a corona discharging device, in the dark, until the surface potential attained an initial value of about 500 volts, as measured by a ESV probe attached to an electrometer. The devices are tested with the exposure light having a measured energy of 2.6 ergs/cm$^2$ and a wavelength of 780 nm, from a filtered xenon lamp. A reduction in the surface potential due to photo discharge effect was measured at 33 and 89 milliseconds after photo discharge.

drop of 424 volts, 29 milliseconds after exposure, with a 1st layer (bottom layer) thickness of 17.3 um and a 2nd layer (top layer) thickness of 12 um has an approximately 200 percent increase in discharge rate over the comparative example 1 which has an initial voltage of 500 volts and a voltage drop of 424 volts, 89 milliseconds after exposure.

Lateral Charge Migration (LCM) resistance was evaluated by a lateral charge migration (LCM) print testing scheme. The above prepared hand coated photoconductor devices were cut into 6"×1" strips. One end of the strip from the respective devices was cleaned using a solvent to expose the metallic conductive layer on the substrate. The conductivity of the exposed metallic TiZr conductive layer was then measured to ensure that the metal had not been removed during cleaning. The conductivity of the exposed metallic TiZr conductive layer was measured using a multimeter to measure the resistance across the exposed metal layer (around 1 KOhm). A fully operational 85 mm DC12 A Xerox Corporation standard Docu Color photoreceptor drum was prepared to expose a strip around the drum to provide the ground for the hand-coated device when it is operated. The cleaning blade was removed from the drum housing to prevent it from removing the hand coated devices during operation.

The imaging member from Examples 1 through 5 as well as comparative example 2 were then mounted onto a photoreceptor drum using conductive copper tape to adhere the exposed conductive end of the devices to the exposed aluminum strip on the drum to complete a conductive path to the ground. After mounting the devices, the device-to-drum conductivity was measured using a standard multimeter in a resistance mode. The resistance between the respective devices and the drum should be similar to the resistance of the conductive coating on the respective hand coated devices. The ends of the devices are then secured to the drum using scotch tape, and all exposed conductive surfaces were covered with scotch tape. The drum was then placed in a Docucolor 12 (DC12) machine and a template containing 1 bit, 2 bit, 3 bit, 4 bit, and 5 bit lines was printed. The machine settings (developer bias, laser power, grid bias.) were adjusted to obtain visible print that resovled the 5 individual lines above. If the 1 bit line is barely showing, then the settings are

TABLE 1

| Example | 1st Layer CTL Bottom Layer Thickness (μm) | 2nd Layer CTL (Top Layer) Thickness (μm) | CTL Total Thickness (μm) | 1st Layer CTL (Bottom Layer) wt % Compound 1 | 2nd Layer CTL (Top Layer) wt % Compound 1 | 1st layer CTL (Bottom Layer) wt % Compound 2 | 2nd Layer CTL (Top Layer) wt % Compound 2 | Volts at 89 ms after exposure (2.6 ergs/cm$^2$) | Volts at 29 ms after exposure (2.6 ergs/cm$^2$) |
|---|---|---|---|---|---|---|---|---|---|
| 1 | 15.5 | 15.5 | 31.0 | 51.1 | 9.4 | 6.8 | 6.8 | 65 | 110 |
| 2 | 17.3 | 12.0 | 29.3 | 51.1 | 9.4 | 6.8 | 6.8 | 51 | 76 |
| 3 | 20.5 | 10.1 | 30.6 | 51.1 | 9.4 | 6.8 | 6.8 | 46 | 64 |
| 4 | 15.8 | 15.9 | 31.7 | 55 | 9.4 | 0 | 6.8 | 64 | 105 |
| 5 | 21.4 | 9.5 | 30.9 | 55 | 9.4 | 0 | 6.8 | 29 | 46 |
| Comparative example 1 | n/a | n/a | 29 | — | — | — | — | 76 | 105 |

The test results demonstrate that that the discharge rate of an imaging member with two layer charge transport layer comprising a 1st layer (bottom layer) charge transport layer containing Compound 1 and Compound 2, or without Compound 2, and a 2nd$^t$ layer (top layer) charge transport layer containing Compound 1 and Compound 2, may be tuned, that is, the voltage drop over specific time intervals can be selected by varying the thickness of the 1st and 2nd layer charge transport layers. The voltage data in Table 1 demonstrates that Example 2 having an initial voltage of 500 volts and a voltage saved and the print becomes the reference, or the pre-exposure print. The drum was removed and placed in charge-discharge apparatus generates corona discharge during operation. The drum was charged and discharged (cycled) for 20,000 cycles to induce deletion (LCM). The drum was then removed from the apparatus and placed in the DC12 machine and the template was printed again.

The imaging member from Examples 1 through 5 with high quality N,N,N'N'-tetra(4-methylphenyl)-(1,1'-biphenyl)-4,4'-diamine and 2,2'-Methylenebis(4-ethyl-6-tert-butylphenol), in a two layer tunable discharge speed charge transport layer configuration, exhibit excellent LCM resistance after 20,000 cycles. The 1 bit, 2 bit, 3 bit, 4 bit, 5 bit lines are all visible when printed. For example 5 the 1 bit, 2 bit, 3 bit, 4 bit lines are all visible. In contrast the comparative example 2 with high quality N,N,N'N'-tetra(4-methylphenyl)-(1,1'-biphenyl)-4,4'-diamine in a single pass configuration shows a much lower level of deletion resistance after 20,000 cycles with no lines visible.

In summary, imaging members employing a charge transport layer comprising a variable thickness $1^{st}$ layer (bottom layer) and a variable thickness $2^{nd}$ layer (top layer) have demonstrated wide latitude in tunability of discharge rate as well as high resistance to LCM.

All the patents and applications referred to herein are hereby specifically, and totally incorporated herein by reference in their entirety in the instant specification.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material

What is claimed is:

1. A method of forming an imaging member comprising:
(a) providing a substrate;
(b) forming an undercoat layer on the substrate;
(c) forming a charge generation layer on the undercoat layer; and
(d) forming a tunable charge transport layer on the charge generation layer, wherein the charge transport layer comprises a bottom layer and a top layer formed by dispersing a high concentration of a first charge transport molecule in a polymer binder to form the bottom layer and dispersing a low concentration of a second charge transport molecule in a polymer binder to form the top layer, and wherein thickness of the bottom layer and the top layer are selected in accordance with a combination of pre-determined parameters comprising discharge, discharge interval and light intensity to adjust discharge rate of the imaging member.

2. The method of claim 1, wherein the pre-determined discharge is from about 50 percent to about 98 percent of initial surface potential of the imaging member.

3. The method of claim 1, wherein the pre-determined discharge interval is from about 10 milliseconds to about 1000 milliseconds.

4. The method of claim 1, wherein the pre-determined light intensity is from about 2 ergs/cm$^2$ to about 30 ergs/cm$^2$.

5. The method of claim 1, wherein the bottom layer has a thickness of from about 5 microns to about 25 microns and the top layer has a thickness of from about 5 microns to about 25 microns.

6. The method of claim 5, wherein the bottom layer has a thickness of from about 15 microns to about 22 microns and the top layer has a thickness of from about 9 microns to about 16 microns.

7. The method of claim 1, wherein the bottom layer and the top layer have a combined thickness of from about 10 microns to about 50 microns.

8. The method of claim 1, wherein the bottom layer and the top layer have a combined thickness of from about 25 microns to about 35 microns.

9. The method of claim 1, wherein the bottom layer has a concentration of the first charge transport molecule from about 45 percent to about 65 percent by weight of the polymer binder or from about 50 percent to about 55 percent by weight of the polymer binder.

10. The method of claim 1, wherein the top layer has a concentration of second charge transport molecule of from about 0 percent to about 20 percent by weight of the polymer binder or from about 5 percent to about 15 percent by weight of the polymer binder.

11. The method of claim 1, wherein an anti-oxidant material is further added to the top layer.

12. The method of claim 11, wherein the anti-oxidant material is a phenolic material.

13. The method of claim 11, wherein the anti-oxidant material is 2,2'-Methylenebis(4-ethyl-6-tert-butylphenol).

14. The method of claim 1, wherein an anti-oxidant material is further added to the top layer and the bottom layer.

15. The method of claim 14, wherein the anti-oxidant material is a phenolic material.

16. The method of claim 14, wherein the anti-oxidant material 2,2'-Methylenebis(4-ethyl-6-tert-butylphenol).

17. The method of claim 1, wherein the top layer and the bottom layer comprise a tertiary aryl amine charge transport molecule represented by the following general formula:

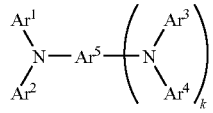

wherein $Ar^1$, $Ar^2$, $Ar^3$, $Ar^4$ and $Ar^5$ each independently represents a substituted or unsubstituted aryl group, or $Ar^5$ independently represents a substituted or unsubstituted arylene group, and k represents 0 or 1.

18. The method of claim 1, wherein the first and second charge transport molecule is N,N,N'N'-tetra(4-methylphenyl)-(1,1'-biphenyl)-4,4'-diamine.

19. A method of forming an imaging member comprising:
(a) providing a substrate;
(b) forming an undercoat layer on the substrate;
(c) forming a charge generation layer on the undercoat layer; and
(d) forming a tunable charge transport layer on the charge generation layer, wherein the charge transport layer comprises a bottom layer and a top layer formed by dispersing from about 50 percent to about 55 percent of a first charge transport molecule in a polymer binder to form the bottom layer and dispersing from about 5 percent to about 15 percent of a second charge transport molecule in a polymer binder to form the top layer, and wherein thickness of the bottom layer and the top layer are selected in accordance with a combination of pre-determined parameters comprising discharge, discharge interval and light intensity to adjust discharge rate of the imaging member.

20. A method of forming an imaging member comprising:
(a) selecting a pre-determined discharge and a pre-determined discharge interval and a pre-determined light intensity for an imaging member; and (b) forming the imaging member having the pre-determined discharge and the pre-determined discharge interval and the desired light intensity further comprising providing a substrate;

forming an undercoat layer on the substrate;

forming a charge generation layer on the undercoat layer; and forming a tunable charge transport layer on the charge generation layer, wherein the charge transport layer comprises a bottom layer and a top layer formed by dispersing a high concentration of high quality N,N,N'N'-tetra(4-methylphenyl)-(1,1'-biphenyl)-4,4'-diamine in a polymer binder to form the bottom layer and dispersing a low concentration of high quality N,N,N'N'-tetra(4-methylphenyl)-(1,1'-biphenyl)-4,4'-diamine in a polymer binder to form the top layer and wherein thickness of the bottom layer and the top layer are selected in accordance with a combination of pre-determined parameters comprising discharge, discharge interval and light intensity to adjust discharge rate of the imaging member.

* * * * *